US008998658B2

(12) United States Patent
Borst et al.

(10) Patent No.: US 8,998,658 B2
(45) Date of Patent: Apr. 7, 2015

(54) CONNECTING TERMINAL HAVING CLAMP CONTACTS

(71) Applicants: Joachim Borst, Donaueschingen (DE); Peter Wicht, Braeunlingen (DE); Hermann Stadler, Donaueschingen (DE)

(72) Inventors: Joachim Borst, Donaueschingen (DE); Peter Wicht, Braeunlingen (DE); Hermann Stadler, Donaueschingen (DE)

(73) Assignee: MCQ Tech GmbH, Blumberg (DE)

( * ) Notice: Subject to any disclaimer, the term of this patent is extended or adjusted under 35 U.S.C. 154(b) by 92 days.

(21) Appl. No.: 13/658,009

(22) Filed: Oct. 23, 2012

(65) Prior Publication Data

US 2013/0288549 A1 Oct. 31, 2013

(30) Foreign Application Priority Data

Nov. 15, 2011 (DE) ..... 10 2011 086 331

(51) Int. Cl.

| | |
|---|---|
| ***H01R 4/18*** | (2006.01) |
| ***H01R 4/48*** | (2006.01) |
| ***H01R 9/24*** | (2006.01) |
| *H01R 43/16* | (2006.01) |
| *H01R 43/24* | (2006.01) |

(52) U.S. Cl.

CPC ..... *H01R 4/48* (2013.01); *H01R 9/2425* (2013.01); *H01R 43/16* (2013.01); *H01R 43/24* (2013.01)

(58) Field of Classification Search

USPC ..... 439/867, 797, 786, 793, 714, 607.07

See application file for complete search history.

(56) References Cited

U.S. PATENT DOCUMENTS

| | | | | |
|---|---|---|---|---|
| 5,066,236 | A * | 11/1991 | Broeksteeg | 439/79 |
| 5,655,922 | A | 8/1997 | Dux | |
| 6,979,226 | B2 * | 12/2005 | Otsu et al. | 439/607.07 |
| 7,201,601 | B2 * | 4/2007 | Lappohn | 439/404 |
| 7,462,076 | B2 * | 12/2008 | Walter et al. | 439/709 |
| 7,918,693 | B2 * | 4/2011 | Thomas | 439/797 |
| 8,366,479 | B2 * | 2/2013 | Borst et al. | 439/567 |
| 8,430,697 | B2 * | 4/2013 | Gassauer et al. | 439/835 |
| 2003/0203676 | A1 * | 10/2003 | Hasircoglu | 439/608 |
| 2004/0047118 | A1 | 3/2004 | Bergmann | |
| 2005/0032430 | A1 * | 2/2005 | Otsu et al. | 439/608 |
| 2007/0238303 | A1 * | 10/2007 | Walter et al. | 438/709 |
| 2012/0077355 | A1 * | 3/2012 | Borst et al. | 439/55 |

FOREIGN PATENT DOCUMENTS

| | | | |
|---|---|---|---|
| DE | 21 16 026 | A1 | 4/1971 |
| DE | 35 02 813 | A1 | 7/1986 |
| DE | 29 901 194 | U1 | 5/1999 |
| DE | 10 2007 0004 865 | A1 | 8/2008 |
| DE | 10 2009 026 459 | A1 | 12/2010 |
| DE | 10 2010 016 865 | A1 | 11/2011 |
| EP | 0235320 | A1 | 9/1987 |
| FR | 2140694 | A5 | 1/1973 |
| WO | WO 2009105887 | A2 | 2/2009 |

* cited by examiner

*Primary Examiner* — Hae Moon Hyeon

(74) *Attorney, Agent, or Firm* — Todd L. Juneau

(57) ABSTRACT

The invention relates to a terminal with a housing, with at least two clamp contacts to produce an electronic connection to electric contacts and with connection elements for producing an electric connection to an electronic sub-assembly arranged outside the electrical terminal block, with the electrical terminal block comprising an electronic sub-assembly and with the clamp contacts being connected via the electronic sub-assembly to connection elements as well as an electrical terminal block-circuit board arrangement with an electronic sub-assembly in the form of a circuit board and with a terminal electrically connected to the electronic sub-assembly.

12 Claims, 12 Drawing Sheets

CONNECTING TERMINAL HAVING CLAMP CONTACTS

CROSS REFERENCE TO RELATED APPLICATIONS

The present application claims priority to German Patent Application No. 10 2011 086 331.1, filed on Nov. 15, 2011.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

FIELD OF THE INVENTION

Known terminals are passive electro-mechanical components. They are commonly used in order to produce an electric connection from an electric connector, particularly a wire or cable, to an electronic sub-assembly, particularly an electronic sub-assembly in the form of a populated circuit board. In the meantime a plurality of most different variants of such terminals are commercially available. On the one hand, depending on the type of connection between the terminal and the circuit board, it is distinguished between plug-in and soldered connectors. On the other hand, depending on the type of connection between terminals and the circuit board, it is distinguished between screwed terminals, in which the electric contact is ensured between these components by way of screwing, and spring clips, in which the electric contact is ensured by way of a spring force. Here, the size of the terminal is essentially determined by the size of the electric connections.

BACKGROUND

A trend in recent years, continuously dominating the further development of electronic devices, is the intent for increasing miniaturization. Due to the fact that the electronic components of these devices are generally arranged on circuit board, in order to promote miniaturization, the size of the circuit board must be reduced. This leads to increasingly denser population of these circuit boards, which is respectively limited by the maximum population density which can be technically realized.

A trend in recently years, continuously dominating the further development of electronic devices, is the intent for increasing miniaturization. Due to the fact that the electronic components of these devices are generally arranged on circuit board, in order to promote miniaturization, the size of the circuit board must be reduced. This leads to increasingly denser population of these circuit boards, which is respectively limited by the maximum population density which can be technically realized.

The objective of the invention therefore comprises to allow further miniaturization of electronic devices. This objective is attained in an electrical terminal block with a housing, at least two clamp contacts to producing an electric connection with electric connectors and with connection elements to produce an electric connection to an electronic sub-assembly arranged outside the electrical terminal block wherein the terminal comprises an electric sub-assembly and that the clamp contacts are connected via the electronic sub-assembly to connection elements. An additional objective is a terminal comprising features of the preceding sentence further comprising electronic sub-assemblies in the form a circuit board arrangement.

SUMMARY OF THE INVENTION

An object of the present invention is to provide a terminal and/or circuit board arrangement with features allowing for increased miniaturization.

In a preferred embodiment, an electrical terminal block with a housing, at least two clamp contacts to producing an electric connection with electric connectors and with connection elements to produce an electric connection to an electronic sub-assembly arranged outside the electrical terminal block wherein the electrical terminal block comprises an electronic sub-assembly and that the clamp contacts are connected via the electronic sub-assembly to connection elements.

The disclosed electrical terminal block, further comprising wherein the electronic sub-assembly included in the electrical terminal block comprises at least one contact area and that at least one clamp contact or at least one connection element, is electrically connected via a spring element, pressing onto the contact area to the electronic sub-assembly.

The disclosed electrical terminal block, further comprising wherein at least two clamp contacts show another contact area, which is embodied in a spring-loaded fashion, so that an additional electronic sub-assembly, particularly a resistor, can be arranged at the electrical terminal block.

The disclosed electrical terminal block, further comprising wherein the electrical terminal block is surrounded by a shielding housing.

The disclosed electrical terminal block, further comprising wherein the electronic sub-assembly included in the electrical terminal block is a populated circuit board.

The disclosed electrical terminal block, further comprising wherein the electronic sub-assembly included in the electrical terminal block is embodied as a populated punch scrap.

The disclosed electrical terminal block, further comprising wherein the populated punch scrap is coated by way of injection molding.

The disclosed electrical terminal block, further comprising wherein the clamp contacts and/or the connection elements are integrated in the punch scrap.

The disclosed electrical terminal block, further comprising wherein the punch scrap shows severed connection bars.

The disclosed electrical terminal block, further comprising wherein the electronic sub-assembly included in the electrical terminal block forms a part of the housing of the terminal.

An electrical terminal block-circuit board arrangement with electronic sub-assemblies in the form of circuit boards and with a terminal electrically connected to the electronic sub-assembly any of the disclosed electrical terminal block designs.

BRIEF DESCRIPTION OF THE DRAWINGS

These and other features of the invention will become more apparent in the following detailed description in which reference is made to the appended drawings.

DETAILED DESCRIPTION OF THE INVENTION

Figure 1:
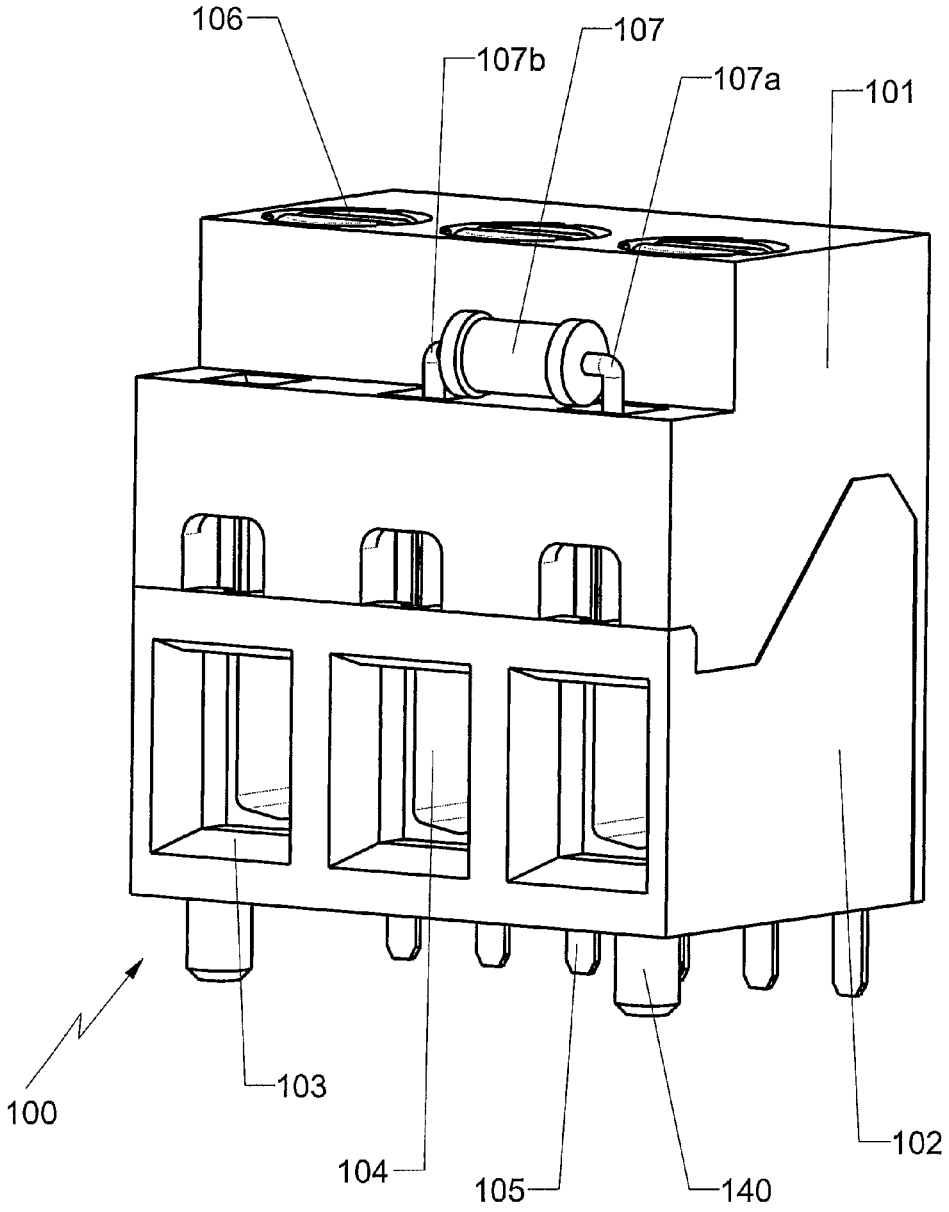
FIG. 1 is an exterior view of a first exemplary embodiment of an electrical terminal block, seen diagonally from the front.

Unless defined otherwise, all technical and scientific terms used herein have the same meaning as commonly understood by one of ordinary skill in the art to which this invention belongs.

The invention will now be described with reference to specific examples. It will be understood that the following examples are intended to describe embodiments of the invention and are not intended to limit the invention in any way.

The present invention involves the electrical terminal block according to the invention comprises a housing, at least two clamp contacts for producing an electric connection with electric connectors and connection elements for creating an electric connection to an electronic sub-assembly arranged outside the clip connection, which generally but not mandatorily is embodied by a populated circuit board.

Here, it is essential for the invention that the electrical terminal block itself comprises an electronic sub-assembly and that the clip connections are connected via the electronic sub-assembly included in the terminal to the connection elements.

The invention is based on the acknowledgement that it is possible to use the space available in the electrical terminal block, which is predetermined by the size of the connections, for arranging an electronic sub-assembly in the electrical terminal block. It is possible to arrange some of the electronic components required for the desired functions and switched to each other, all of which according to prior art had to be arranged on the electronic sub-assembly outside the electrical terminal block, on the electronic sub-assembly included in the electrical terminal block or on electronic components required for an additional function. As a consequence in both cases the electronic sub-assembly arranged outside the electrical terminal block must show fewer electronic components and thus can be embodied in a more compact fashion.

Particularly the clamp contacts may be embodied as screw-clamp contacts or as spring-loaded clamp contacts, depending on the requirements of the respective application. Depending on the application, the connection elements may be embodied as solder pins, socket elements, or spring-loaded contacts.

In an advantageous embodiment of the invention electronic sub-assembly included in the electrical terminal block comprises at least one contact area and at least one clamp contact or at least one connection element is connected via a spring-loaded element acting upon the contact area to an electronic sub-assembly included in the electrical terminal block. This embodiment allows in a simple and yet reliable fashion to yield an electric contact to the electronic sub-assembly. When further all contacts required by the electronic sub-assembly are embodied in this manner there is the option, on the one side, to exchange the electronic sub-assembly included in the electrical terminal block, while on the other side a standardization of the electrical terminal block occurs so that it is avoided that for each electronic sub-assembly to be arranged at the electrical terminal block a separate serial production must be initiated.

A separate invention is represented by the electrical terminal block according to the preamble of claim 1, in which at least two clamp contacts show an additional contact area, which is embodied spring-loaded such that an additional electronic component, particularly a resistor, can be arranged at the electrical terminal block, namely preferably between the two clamp contacts showing said spring-loaded contact area.

This way it is possible to conclude a component perhaps connected to the electrical terminal block with a respective electronic signal bus, for example when the electronic sub-assembly contacting the electrical terminal block represents a transceiver circuit with an allocated signal bus and the additional electronic component is a resistor.

Obviously the same advantages are also expected when the electrical terminal block itself comprises an electronic sub-assembly and when the clamp contacts are connected via an electronic sub-assembly included in the electrical terminal block to the connection elements so that a respective embodiment of the electrical terminal block according to claim 1 is also advantageous. In this context, in particular, the option must be pointed out that the electronic sub-assembly included in the electrical terminal block is a transceiver circuit with a signal bus allocated thereto and the electronic component is a load resistor appropriately adjusted thereto.

According to another advantageous further development of the electrical terminal blocks according to the invention it is provided that the electrical terminal block is surrounded by a shielding housing, particularly made from metal. This is particularly important in the type of electrical terminal blocks disclosed here, because by providing electronic sub-assemblies as a part of the electrical terminal block the sensitivity to interfering radiation is considerably increased. Advantageously the shielding housing is embodied as a press-bent part, which can particularly be pushed onto the electrical terminal block.

An electrical terminal block particularly advantageous for the aspect of standardization provides for an electronic sub-assembly included in the electrical terminal block in the form of a populated circuit board.

However, the alternative is particularly cost-effective in which the electronic sub-assembly included in the electrical terminal block is embodied as a populated punch scrap, with the punch scrap preferably being coated by injection molding. In a punch scrap being the base for the electronic sub-assembly there is additionally the option that the clamp contacts and/or the connection elements are integrated in the punch scrap, which yields an additional reduction in production costs. The punch scrap can here be stabilized during processing by auxiliary bars, which are excluded from the subsequent coating by injection molding and are then severed in order to prevent any current flow via the punch scrap not equivalent to the requirements of the electronic sub-assemblies.

Another cost reduction can be achieved when the electronic sub-assembly included in the electrical terminal block is embodied as a part of the housing of the electrical terminal block. In particular, a populated punch scrap coated by injection molding can be used as a wall and/or base part of the housing.

The electrical terminal block-circuit board arrangement according to the invention comprises an electronic sub-assembly in the form of a circuit board and an electrical terminal block according to the invention electrically connected thereto. The advantages of the above-described further developments of the electrical terminal block can directly be transferred to an electrical terminal block-circuit board arrangement with a circuit board embodied accordingly.

DESCRIPTION OF THE FIGURES

Turning now to the Figures, identical components of the same exemplary embodiments of the electrical terminal block are marked in all figures with the same reference characters, unless indicated otherwise. Further, individual features illustrated based on different exemplary embodiments can be freely combined unless they contradict each other.

The following comprises a listing of parts and associated parts numbers, as used in the Figures described herein beneath:

| | |
|---|---|
| 100, 200, 300 | Terminal |
| 101, 201 | Housing top |
| 102 | Housing bottom |
| 103, 203, 303 | Wire insert opening |
| 104, 204, 304 | Terminal body |
| 105, 205, 305 | Connector |
| 106, 207 | Clamp screw |
| 107, 206, 306 | Electronic component |
| 107a, 107b, 206a, 206b | Connectors |
| 109 | Spring clamps |
| 110 | Spring-loaded contact |
| 111 | Circuit board |
| 112, 212 | Electronic component |
| 113 | Contact area |
| 114 | Spring-loaded contact |
| 115 | Clip contact |
| 121, 122 | Accepting opening |
| 130 | Electronic sub-assembly |
| 140 | Pin |
| 141 | Groove |
| 202 | Electronic sub-assembly, embodied integrated with the housing bottom |
| 208 | Punch scrap |
| 209 | Contact leg |
| 210 | Clip contact |
| 211 | Connecting line |
| 212 | Area |
| 213 | Electronic component |
| 214 | Connecting bar |
| 216 | Precursor of the electronic sub-assembly |
| 217 | Recess |

The first exemplary embodiment of an electrical terminal block 100 illustrated in FIGS. 1 through 5 shows a housing top 101 and a housing bottom 102, jointly forming a housing.

Figure 2:
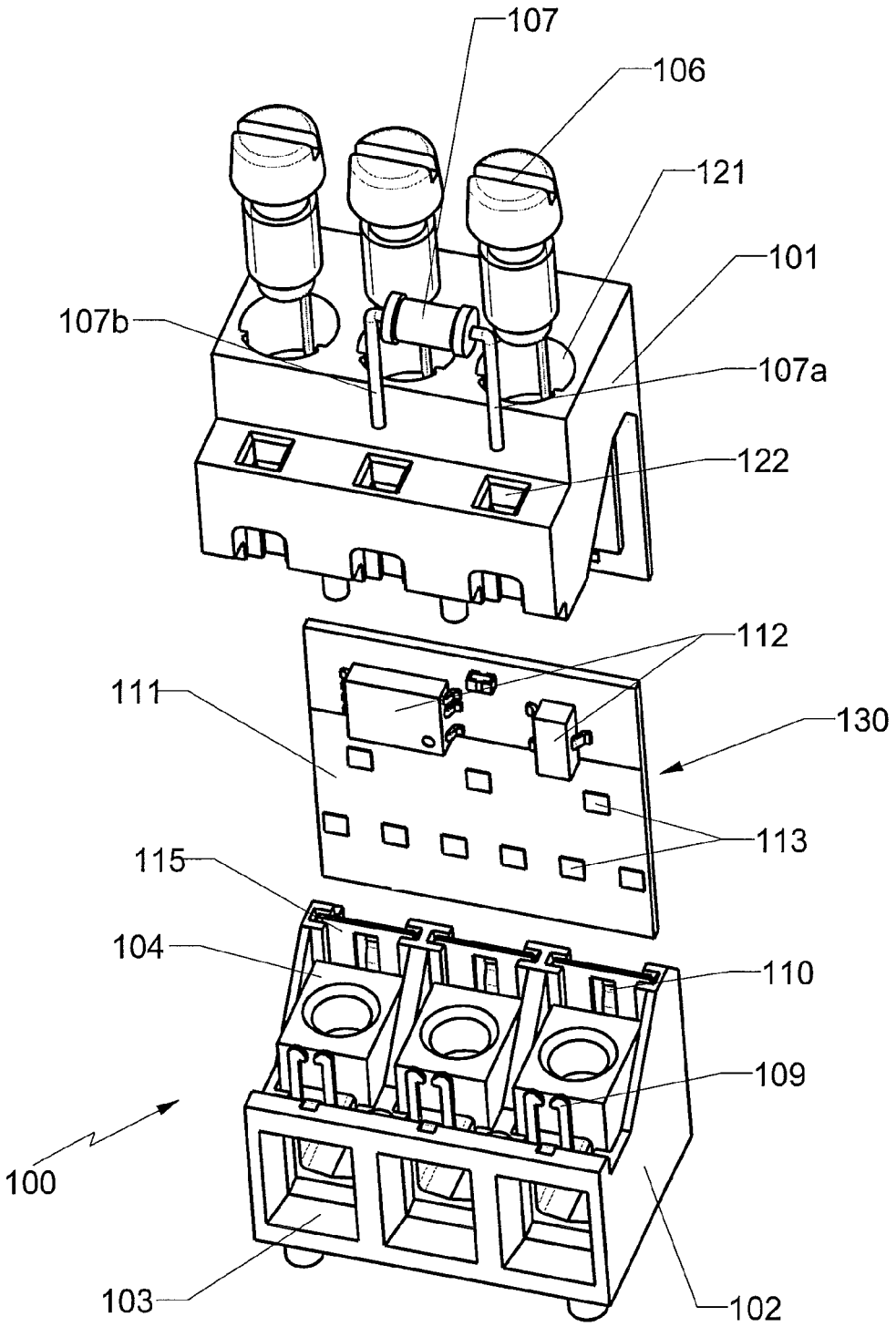
FIG. 2 is an exploded illustration of the electrical terminal block of FIG. 1, seen diagonally from the front.
Figure 3:
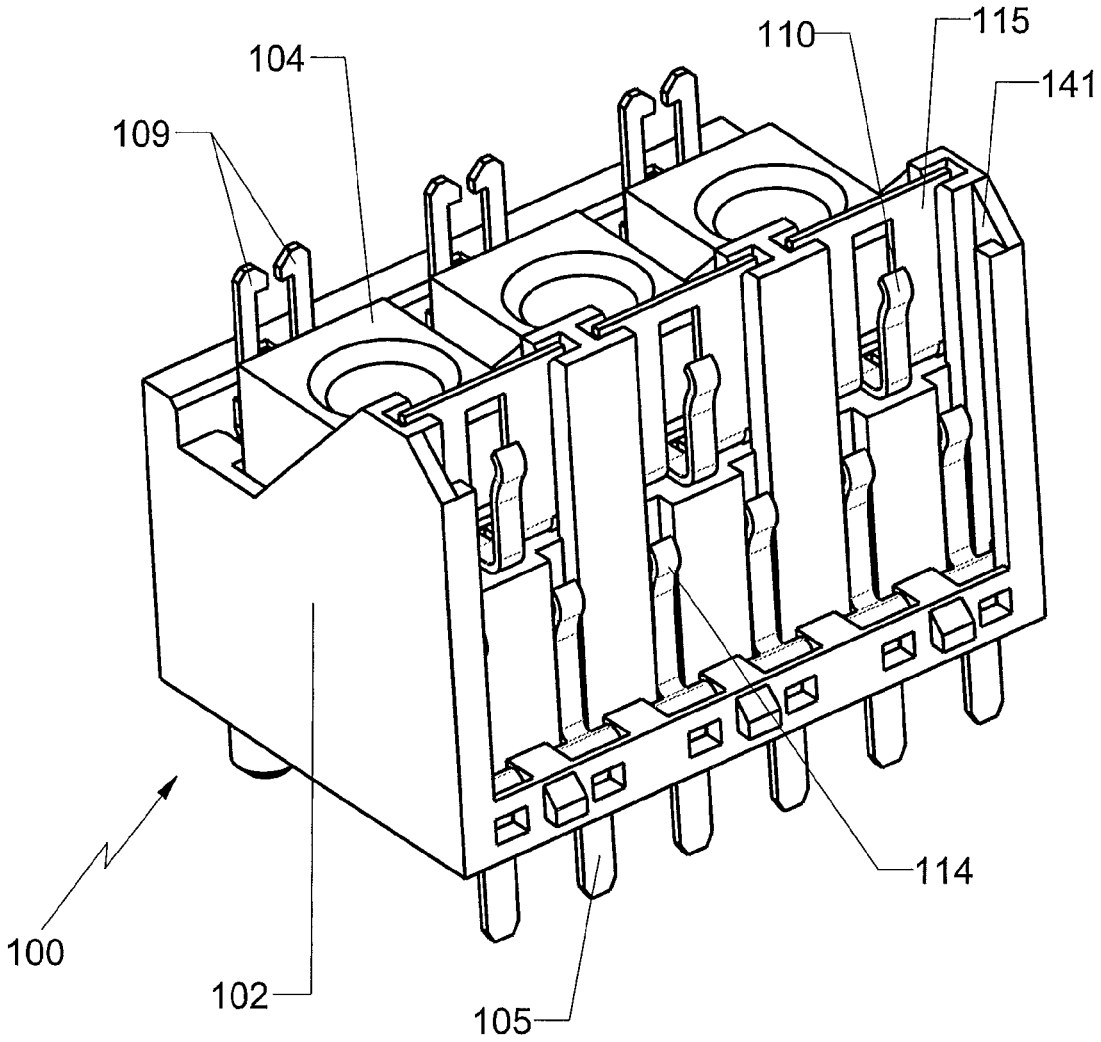
FIG. 3 is a rear view of the housing bottom of the electrical terminal block of FIG. 1.

The housing top 101, as particularly well discernible in the exploded illustration of FIG. 2, shows accepting openings 121 for clamp screws 106 and accepting openings 122 for the connections 107*a*, 107*b* of an electronic component 107, embodied as a resistor.

Figure 4:
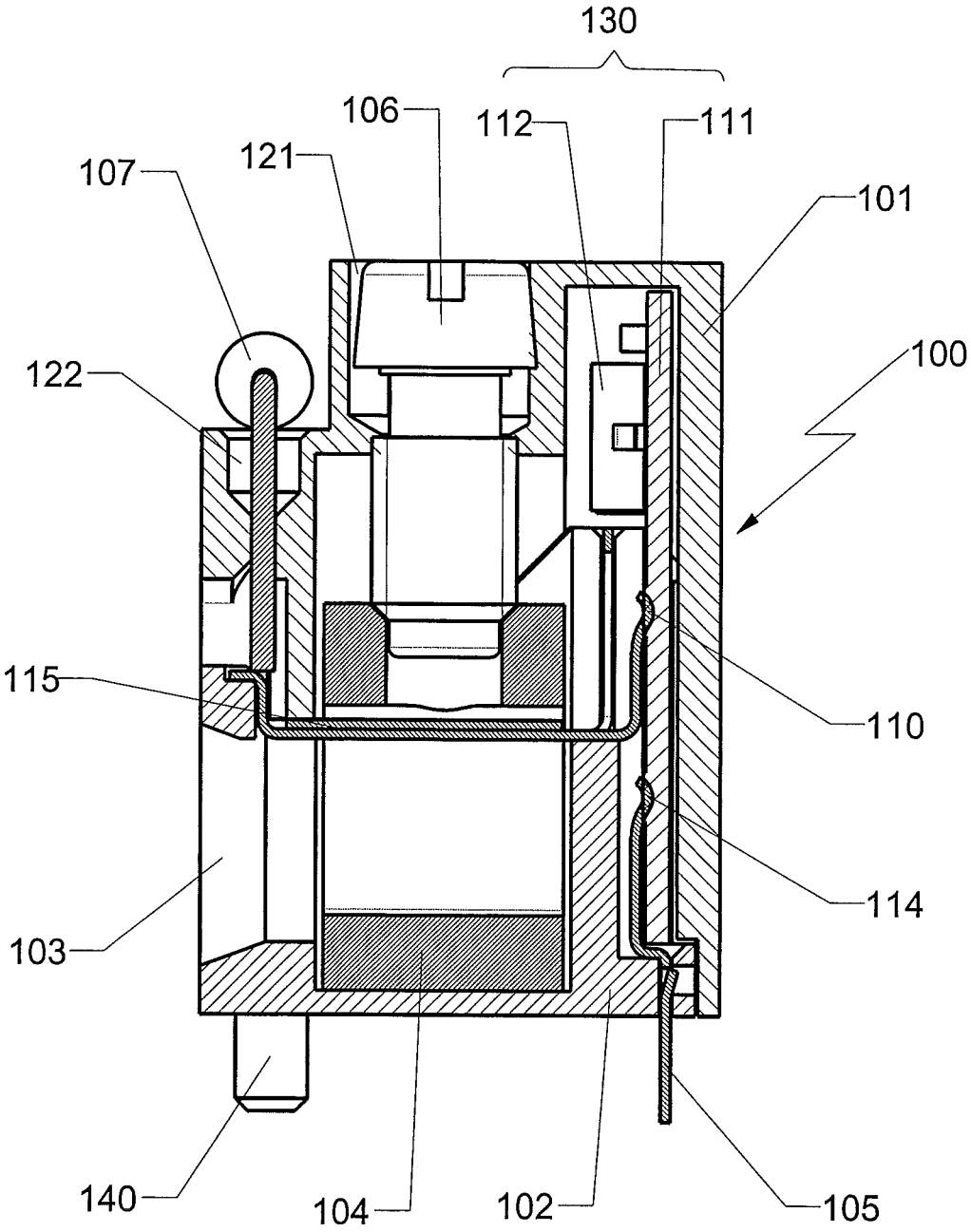
FIG. 4 is a cross-section through the terminal of FIG. 1 in a level parallel to the direction of insertion of connection wires into the electrical terminal block.

As particularly shown in FIGS. 1 and 2, three wire insert openings 103 are provided at the housing bottom 102, through which terminal bodies 104 are discernible by which the connections wires to be inserted, not shown, each can be clamped. The terminal bodies 104 are respective components of contact elements, which for example are embodied as a screw contact, and, as particularly clearly discernible in the cross-sectional illustration according to FIG. 4, show as additional components one of the clamp screws 106 and one clamp contact 115 each.

Figure 5:
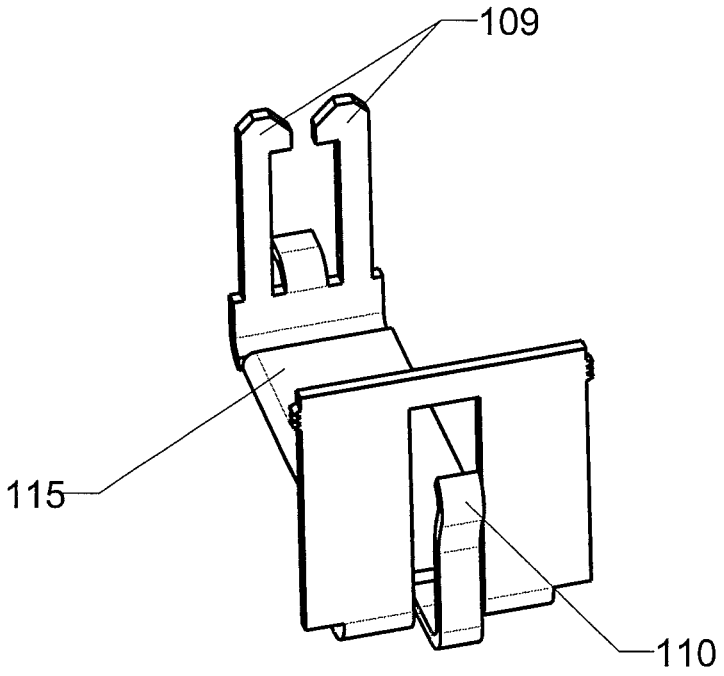
FIG. 5 is the illustration of a clamp contact of the terminal of FIG. 1.
Figure 6:
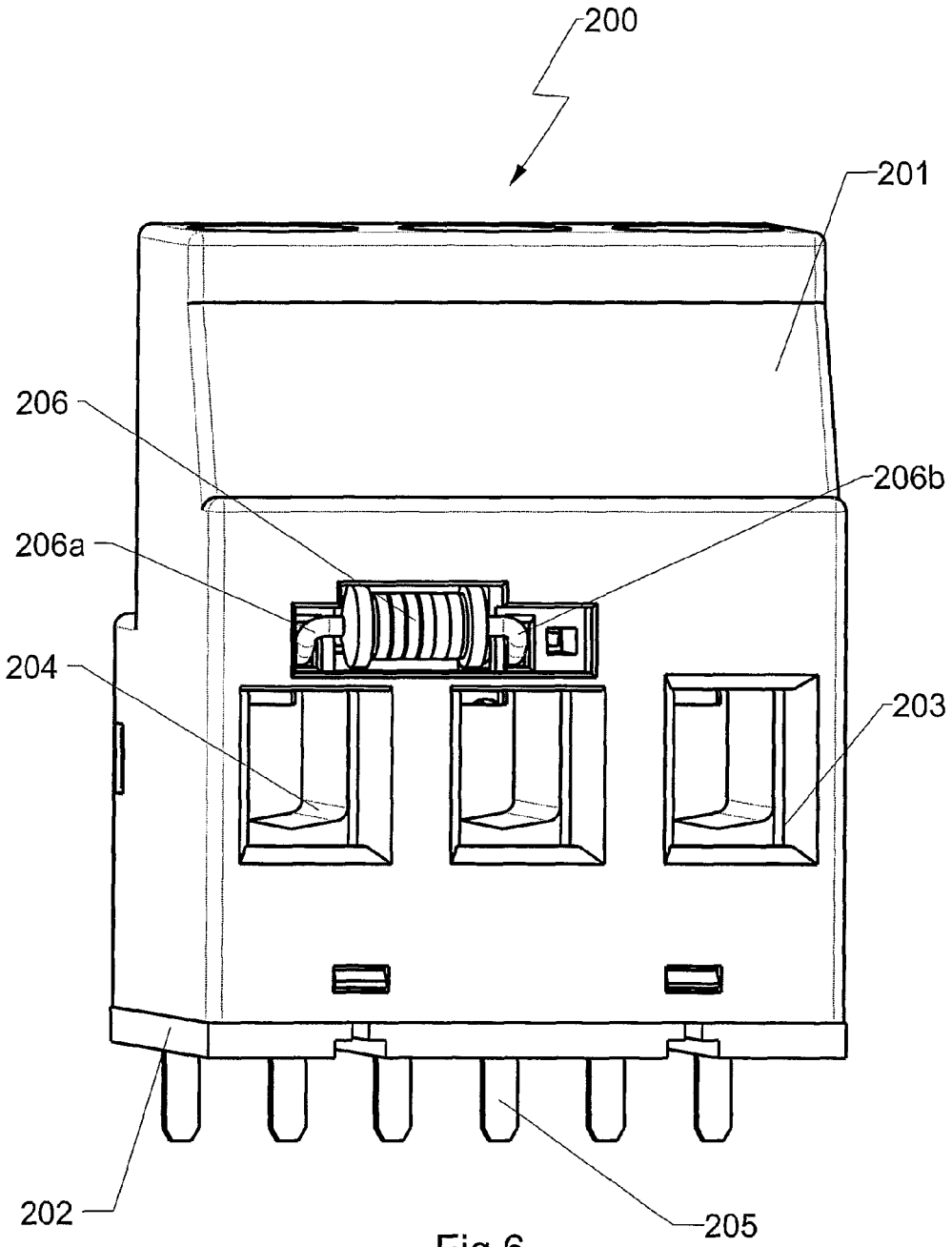
FIG. 6 is an exterior view of a second exemplary embodiment of an electrical terminal block, seen diagonally from the front.

As discernible from FIG. 5, the clamp contact 115 comprises at one of its ends a pair of spring-loaded legs 109, while at its other end a projecting spring-loaded contact 110 is arranged. As best discernible in the cross-sectional illustration of FIG. 4, the pair of spring-loaded legs 109 serves to contact the connections 107*a*, 107*b* of the electronic component 107, with the purpose of the spring-loaded contact 110 being explained in the following.

The clamp contact 115 can be clamped by operating the clamp screw 106 to the connection wire, if a connection wire, not shown, is inserted into the wire insert opening 103, so that an electric contact is ensured between the connection wire and the clamp contact 115.

The housing bottom 102 further comprises a number of connection elements 105 in the form of connection pins, which serve to produce an electric connection with electronic sub-assemblies, not shown, located outside the electrical terminal block 100.

The connection element 105 further comprises one spring-loaded contact 114 each, extending from the housing top 101 and the housing bottom 102 into the housing.

In order to protect the connection elements 105 from bending, which could occur in case of the electrical terminal block 100 being tipped, pins 140 are further arranged at the housing bottom 102, which can engage a respective recess of the electronic sub-assemblies, not shown, arranged outside the electrical terminal block 100.

As particularly well discernible in the exploded illustration according to FIG. 2 an electronic sub-assembly 130 is another components of the electrical terminal block 100, equipped with electronic components 112 and embodied as a circuit board 111 equipped with contact areas 113. The electronic sub-assemblies 130, as clearly discernible from FIG. 3, can be inserted into grooves 141 provided in the housing bottom 102 so that the contact areas 113 of the electronic sub-assemblies 130 is connected in an electric fashion to the spring-loaded contact 110 of the clamp contact 115 and on the other side with the spring-loaded contact 114 of the connection element 105.

The electric connection between the connection wire, not shown, and the electronic sub-assembly, not shown, arranged outside the electrical terminal block 100 therefore occurs via the electronic sub-assembly 130 allocated to the electrical terminal block 100.

Figure 7:
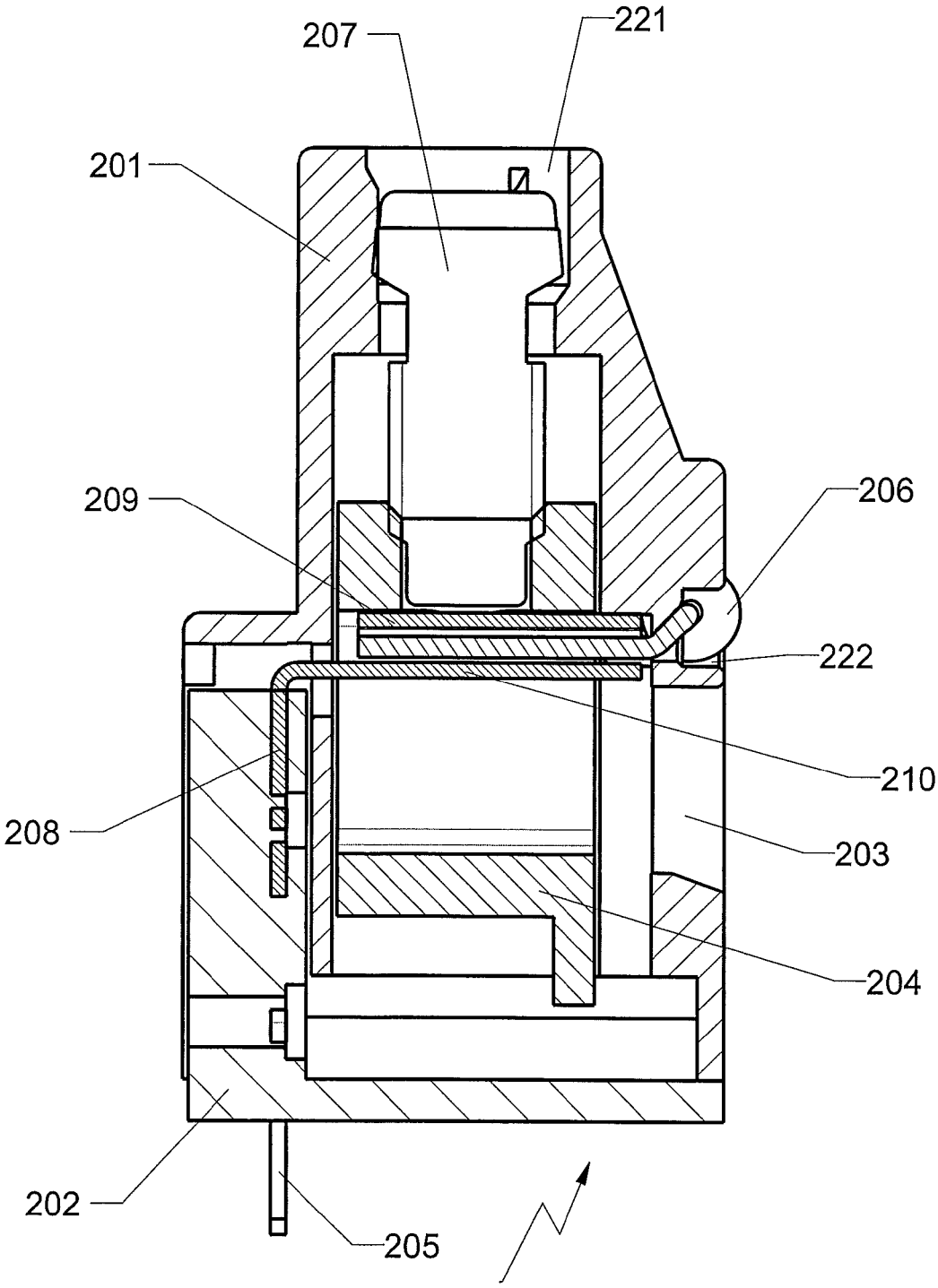
FIG. 7 is a cross-section through the electrical terminal block of FIG. 6 in a level parallel to the direction of insertion of connection wires into the electrical terminal block.
Figure 8:
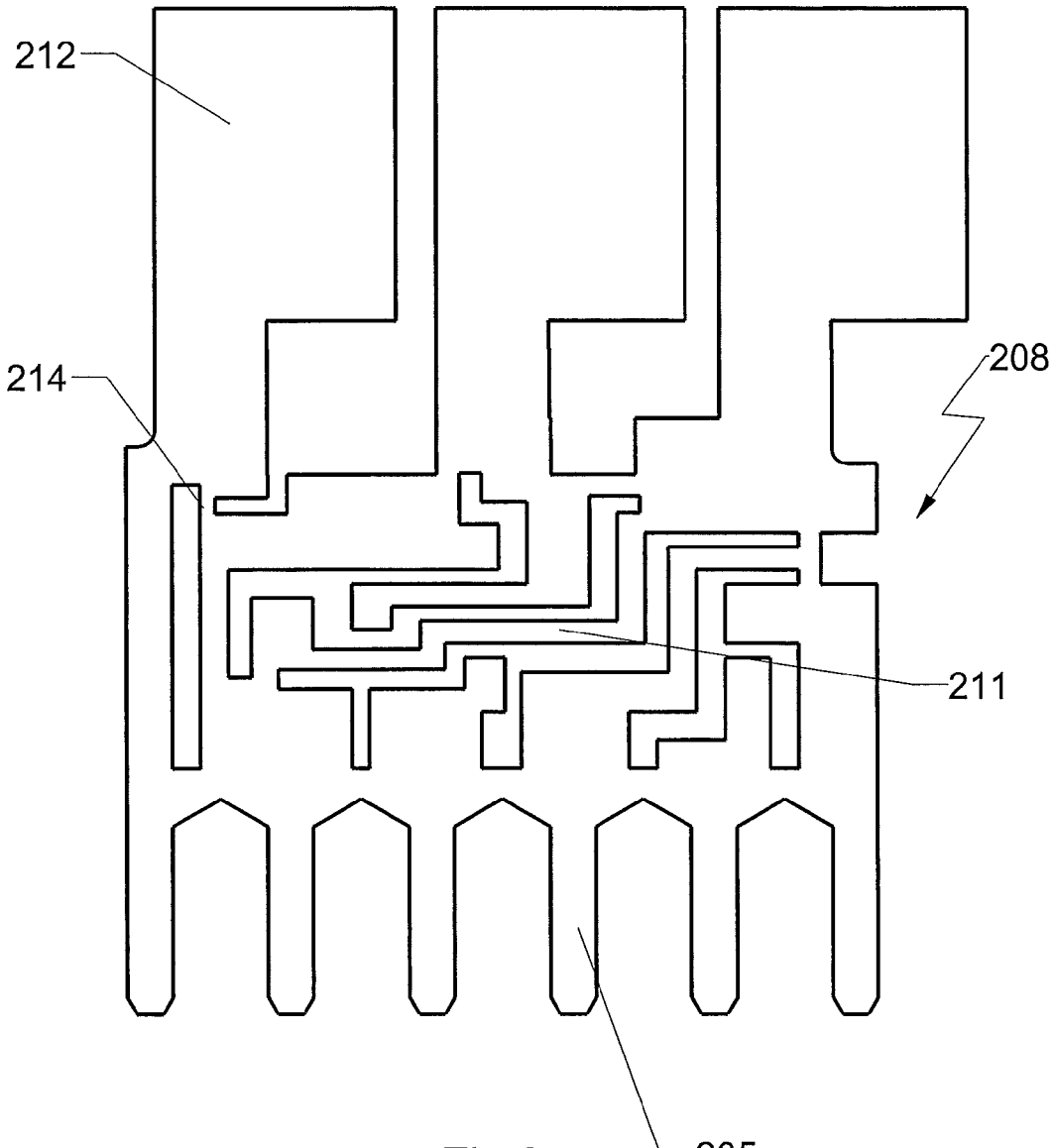
FIG. 8 is a view of the punch scrap used in the electrical terminal block according to FIG. 6 prior to being equipped with electronic components.

The second exemplary embodiment of an electrical terminal block 200, shown in FIGS. 6 through 11, with a housing top 201, a housing bottom formed by the electronic sub-assembly 202, wire insert openings 203, terminal bodies 204, connection elements 205, electronic component 206 with connections 206*a*, 206*b*, clamp screws 207, contact legs 209, clamp contacts 210, and electronic element 213 differ from the exemplary embodiment according to FIGS. 1 through 5 such that the electronic sub-assembly 202 allocated to the electrical terminal block simultaneously forms the housing bottom, based on a punch scrap 208, as shown in FIG. 8, which in particularly is coated by way of injection molding.

The precise design of the electronic sub-assembly 202 forming the housing bottom based on the punch scrap 208 can best be explained by a sequential description of its production based on FIGS. 8 through 11.

First the punch scrap 208 is punched according to FIG. 8. It comprises connection elements 205 in the form of punched connection pins, punched connection lines 211 fulfilling the functions of circuits in a circuit board, and punched areas 212 from which later the contact legs 209 and the clamp contact 210 are formed. Further, a connection bar 214 is shown as an example, serving to stabilize the punch scrap 208 during its production.

Figure 9:
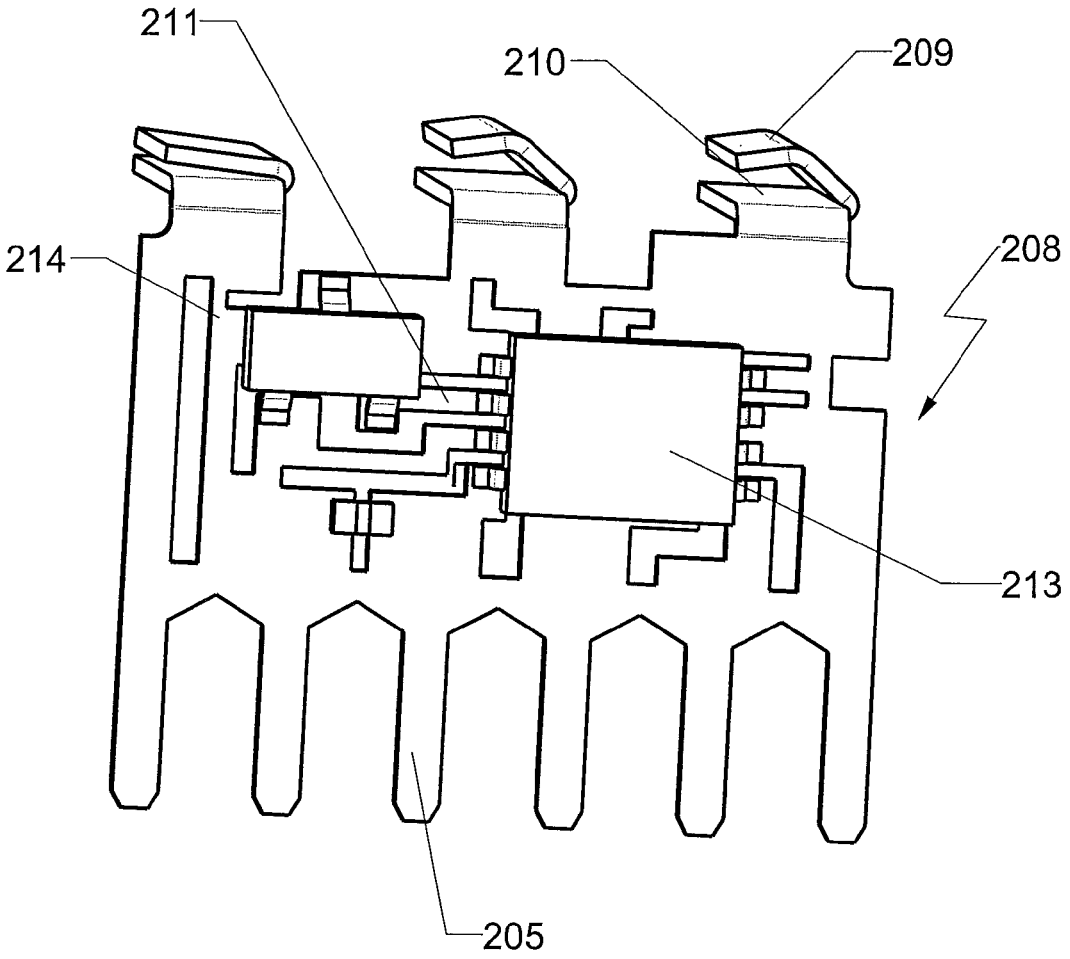
FIG. 9 is the punch scrap of FIG. 8 after being populated with electronic components and a deformation process.

In FIG. 9 the punch scrap according to FIG. 8 is shown after being equipped with electronic components 213, which are arranged according to the respectively necessary circuit layout of the electronic sub-assembly at the connection lines 211. However, due to the fact that connection bars 214 are still present, the electronic sub-assembly 202 is not yet operational and cannot form the housing bottom due to the lack of electronic insulation.

Further, by a dual bending of the punched areas 212 contact legs 209 and clamp contacts 210 have been produced.

Figure 10:
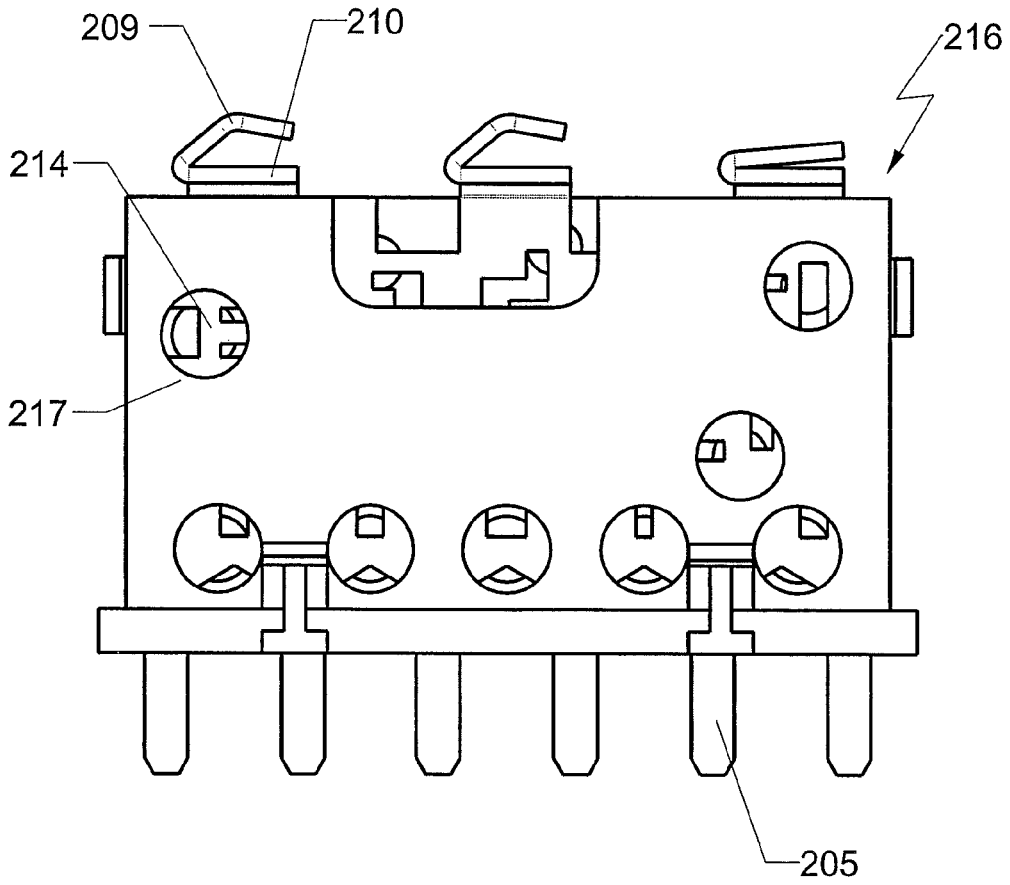
FIG. 10 is the punch scrap according to FIG. 9 after being coated by injection molding.

FIG. 10 shows the punch scrap according to FIG. 9 after a partial coating with plastic in an injection molding process, by which is becomes a precursor of an electronic sub-assembly 216, which however can already serve as a housing part. At the points at which for a duly function of the electronic sub-assembly 202 to be produced connection bars 214, to be severed, are still provided, a recess 217 is provided each in the injection-molded coating. Further, the coating by injection molding is embodied such that particularly the contact legs 209 and the clamp contacts 210 as well as the connection elements 205 project from the injection molded coating and thus are suitable for producing an electric contact.

Figure 11:
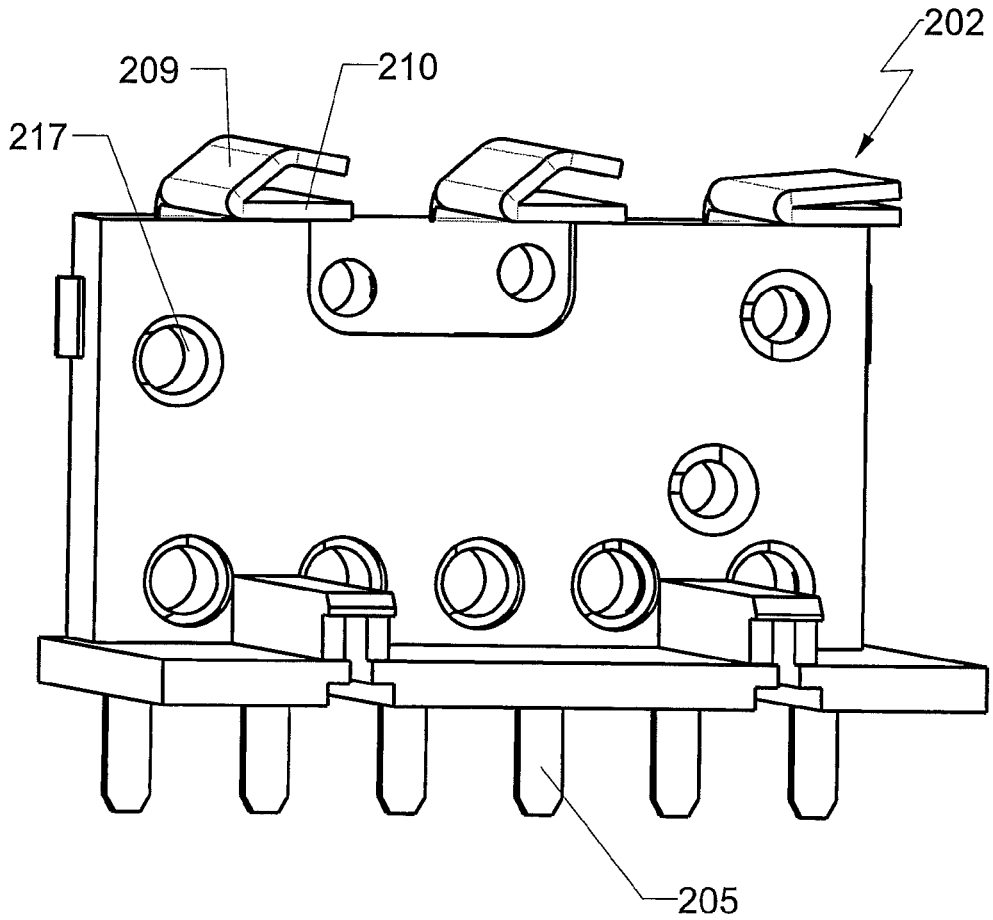
FIG. 11 is the punch scrap according to FIG. 10 after the auxiliary bars have been severed.

FIG. 11 then finally shows that the connection bars 214 to be severed through the recesses 217 have been cut so that the functionality of the electronic sub-assembly 202 based on the punch scrap 208 is ensured and the housing bottom used in the electrical terminal block 200 with an integrated electronic sub-assembly 202 is yielded.

The electric connection between the connection wire, not shown, and the electronic sub-assembly, not shown either, arranged outside the electrical terminal block 200, therefore occurs, as particularly well discernible from the cross-sectional illustration according to FIG. 7, via the electronic sub-assembly 202 coated by way of injection molding, which simultaneously forms the housing bottom of the electrical terminal block 200 and thus is a part of the electrical terminal block 200.

Figure 12:
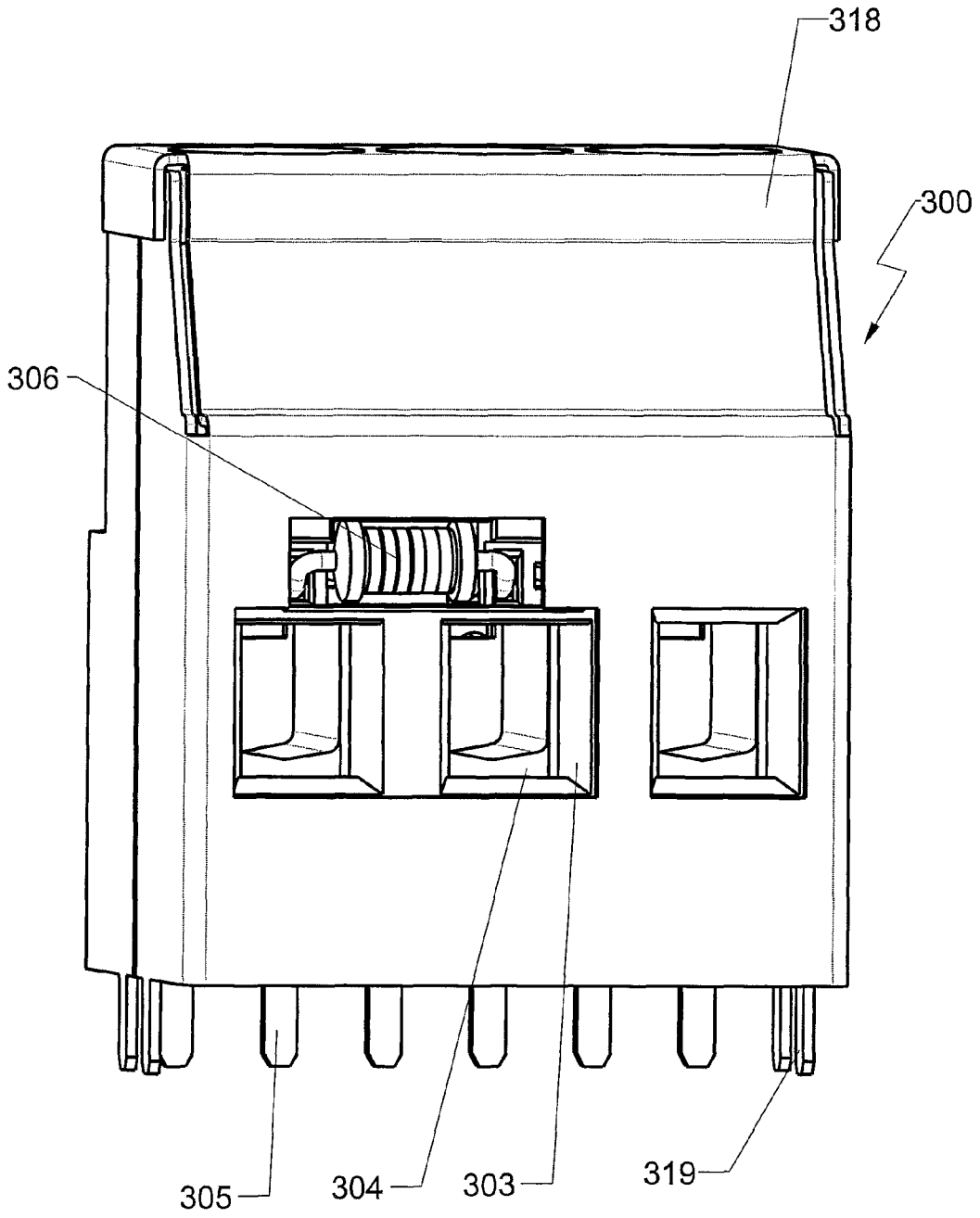
FIG. 12 is a third exemplary embodiment of the electrical terminal block.

The third exemplary embodiment of an electrical terminal block 300, shown in FIG. 12, comprising a wire insert opening 303, terminal body 304, connection element 305, and an electronic component 306 embodied as a resistor differs from the exemplary embodiment shown in FIGS. 6 through 11 only such that a shielding housing 318 with connection pins 319 is provided for protecting against any potential interfering radiation.

Any references cited herein are incorporated herein in their entirety, particularly as they related to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

We claim:

1. An electrical terminal block with a housing, at least two clamp contacts (115) producing an electric connection with an electronic sub-assembly (130) and with connection elements (105), thereby producing a further electric connection to an electronic component (107) arranged outside the electrical terminal block, and wherein the electrical terminal block comprises the electronic sub-assembly (130) and that the clamp contacts are connected via the electronic sub-assembly to connection elements.

2. The electrical terminal block of claim 1, further comprising the electronic sub-assembly included in the electrical terminal block comprises at least one contact area and that at least one clamp contact or at least one connection element, is electrically connected via a spring-loaded contact, pressing onto the contact area of the electronic sub-assembly.

3. The electrical terminal block of claim 1, further comprising at least two clamp contacts show another contact area, which is embodied in a spring-loaded fashion, so that an additional electronic component, particularly a resistor, can be arranged at the electrical terminal block.

4. The electrical terminal block of claim 1, further comprising the electrical terminal block is surrounded by a shielding housing.

5. The electrical terminal block of claim 1, further comprising the electronic sub-assembly included in the electrical terminal block is a populated circuit board.

6. The electrical terminal block of claim 1, further comprising the electronic sub-assembly included in the electrical terminal block is embodied as a populated punch scrap.

7. The electrical terminal block of claim 6, further comprising the populated punch scrap is coated by way of injection molding.

8. The electrical terminal block of claim 6, further comprising the clamp contacts and/or the connection elements are integrated in the punch scrap.

9. The electrical terminal block of claim 6, further comprising the punch scrap shows severed connection bars.

10. The electrical terminal block of claim 1, further comprising the electronic sub-assembly included in the electrical terminal block forms a part of the housing of the electrical terminal block.

11. An electrical terminal block-circuit board arrangement with electronic sub-assemblies in the form of circuit boards and with a terminal electrically connected to the electronic sub-assembly of claim 1.

12. An electrical terminal block-circuit board arrangement with electronic sub-assemblies in the form of circuit boards and with a terminal electrically connected to the electronic sub-assembly of claim 6.

* * * * *